US005632476A

United States Patent [19]

Stauber

[11] Patent Number: 5,632,476

[45] Date of Patent: May 27, 1997

[54] PROCESS AND APPARATUS FOR PRODUCING MULTIPLE-PART PRINTED PRODUCT UNITS

[75] Inventor: Hans-Ulrich Stauber, Grut, Switzerland

[73] Assignee: Ferag AG, Hinwil, Switzerland

[21] Appl. No.: 378,980

[22] Filed: Jan. 27, 1995

[30] Foreign Application Priority Data

Feb. 4, 1994 [CH] Switzerland ..... 00321/94

[51] Int. Cl.[6] ..... B65H 5/30

[52] U.S. Cl. ..... 270/52.19

[58] Field of Search ..... 53/461, 466, 416, 53/134.1, 136.3, 136.5, 206, 389.3, 389.4; 270/55, 54, 53, 57, 52.19, 52.14, 52.21, 52.22; 156/212, 216, 479, 480, 481, 492, 567

[56] References Cited

U.S. PATENT DOCUMENTS

| | | | |
|---|---|---|---|
| 3,951,399 | 4/1976 | Reist . | |
| 4,004,962 | 1/1977 | Kleid | 156/475 |
| 4,160,687 | 7/1979 | Spear | 156/216 X |
| 4,647,333 | 3/1987 | Voltmer et al. | 156/568 X |
| 4,981,291 | 1/1991 | Honegger et al. . | |
| 5,096,176 | 3/1992 | Golicz et al. . | |
| 5,159,798 | 11/1992 | Hannon | 156/216 X |
| 5,165,672 | 11/1992 | Backman | 270/55 |
| 5,309,695 | 5/1994 | Frabetti et al. | 53/136.3 X |
| 5,468,325 | 11/1995 | Eckelt et al. | 156/212 X |

FOREIGN PATENT DOCUMENTS

| | | |
|---|---|---|
| 0019606 | 5/1984 | European Pat. Off. . |
| 4220791 | 1/1994 | Germany . |
| 4220792 | 1/1994 | Germany . |
| 540816 | 10/1973 | Switzerland . |

*Primary Examiner*—Edward K. Look

*Attorney, Agent, or Firm*—Bell, Seltzer, Park & Gibson, P.A.

[57] ABSTRACT

Printed product supplements (20) are arranged in a folded newspaper (10) which serves as outer part of a printed product unit. An adhesive-tape portion (24) connects the two legs (18) of the newspaper (10) to one another in order to stop the supplements (20) from slipping and prevent them from falling out of the newspaper (10). A process and apparatus for producing such printed product units are also disclosed.

14 Claims, 5 Drawing Sheets

PROCESS AND APPARATUS FOR PRODUCING MULTIPLE-PART PRINTED PRODUCT UNITS

BACKGROUND OF THE INVENTION

The present invention relates to a process and to an apparatus for producing multiple-part product units.

Newspapers are often provided with supplements such as magazines, brochures, periodicals and the like. These supplements are loosely arranged in each case between legs of the folded newspaper. There is the danger, when handling these newspapers, that the supplements are displaced or even fall out of the newspaper. The problem arises, in particular, with supplements of a considerable weight and with a large number of supplements. The supplements often consist of high-quality paper with a smooth surface, which is often glossy. This increases the likelihood of slippage of the supplements in the newspaper. Furthermore, in the case of processing newspapers with such supplements, in particular in the despatch room, there is the problem that the supplements are displaced in the newspaper due to their mass inertia; if this occurs in the direction of the fold of the newspaper, then the latter bulges.

The object of the present invention is thus to provide a process and an apparatus for producing product units in which the printed products (newspapers, periodicals, parts thereof as well as supplements) arranged in an outer part are stopped or prevented from being displaced and falling out.

SUMMARY OF THE INVENTION

The above and other objects and advantages of the present invention are achieved in the embodiment illustrated herein by the provision of a process and apparatus for producing multiple-part printed product units, in particular a printed product such as a newspaper, a periodical or a part thereof, or a cover element, and which comprises an outer part which is folded upon itself to define a fold, opposite legs, an open border opposite the fold, and opposite open sides which extend from the fold to the open border. At least one printed product is positioned between the opposite legs of each outer part, and the opposite legs are separably connected to one another either directly or indirectly via the at least one printed product located therebetween.

According to the invention, the legs of the folded outer part, between which the printed products are arranged, are connected to one another either directly or indirectly. This connection, together with the folded outer part, forms a stable unit which stops and/or prevents the printed products from slipping or falling out.

In a particularly preferred embodiment of the invention, a reliable connection of the legs of the outer part is achieved in a simple manner by directly connecting the legs to one another at the open border and/or at the open sides.

In another preferred embodiment, the printed products which are arranged loosely in the outer part are prevented from falling out by means of an adhesive-tape portion. Together with the outer part which encloses the printed products, the adhesive-tape portion forms something of a strapping arrangement. If the outer part is formed by a printed product with an overfold which projects on one leg beyond the other leg, said overfold can be turned over in order to span the gap between the two legs. By means of the adhesive-tape portion, the overfold is retained in a stable manner in this position.

A further embodiment of the invention includes an indirect connection of the legs of the outer part, which is achieved in that the connection is effected via the inserted printed product. In this arrangement, the printed products are stabilized with respect to one another and with respect to the legs.

Preferably, the legs and the printed products located therebetween are connected to one another by means of an anti-slip agent. The anti-slip agent, applied onto the printed products and/or the legs of the outer part in certain areas, increases the friction between the printed products and between the latter and the outer part. Opening of the folded outer part and the removal of the printed products is ensured without damage to the printed products and/or the outer part. The connection can also be produced by means of an adhesion agent. For this purpose, use is made preferably of an adhesion agent which permits the outer part to be opened and the printed products to be removed without any damage.

A further preferred embodiment of the process according to the invention provides that the anti-slip agent and/or adhesion agent is/are applied in a simple manner.

The present invention also involves an apparatus for producing printed product units of the described type and wherein the legs of the outer part, between which printed products are arranged, are connected to one another at the open border and/or at the open sides. In the embodiment wherein the legs are indirectly connected to one another via the printed products located therebetween, the apparatus may comprise conveying means for individually transporting the printed products, and means for applying a connection agent on the outer side of the printed products. The printed products are then brought together with the outer parts.

BRIEF DESCRIPTION OF THE DRAWINGS

The present invention will now be described in more detail with reference to the drawings in which, purely schematically.

DETAILED DESCRIPTION OF THE PREFERRED EMBODIMENTS

Figure 1:
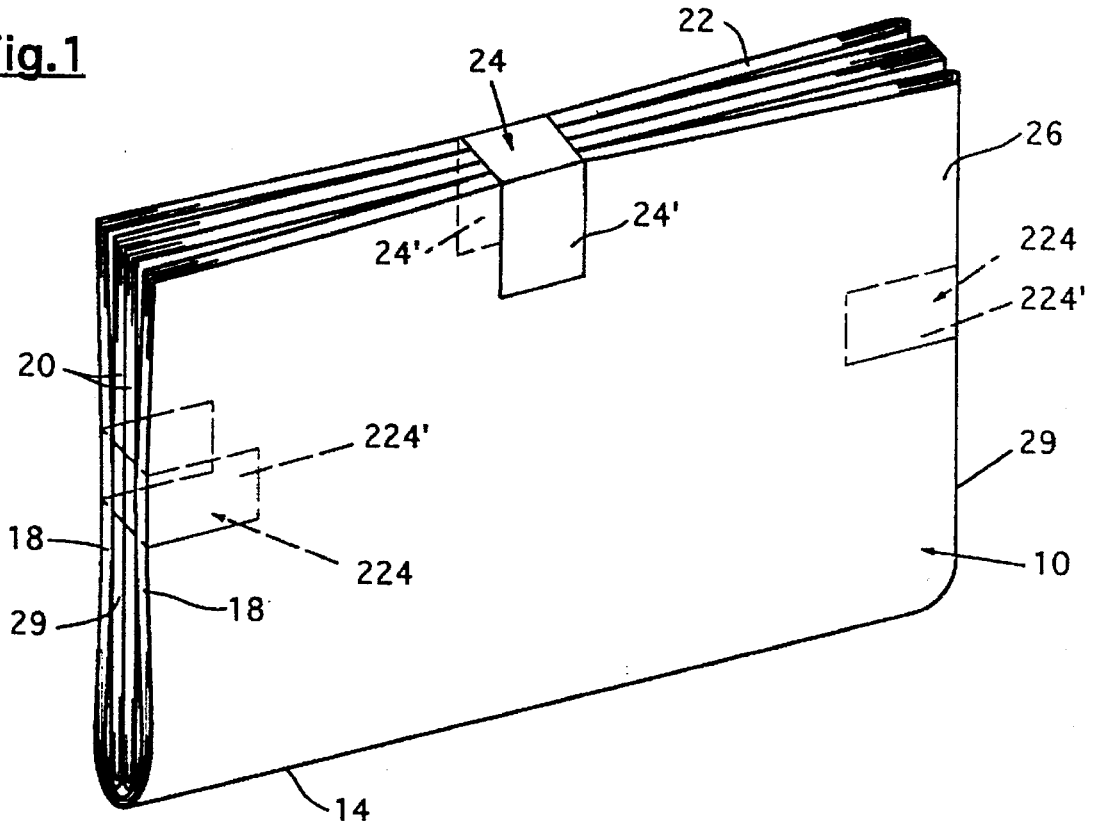
FIG. 1 shows, in perspective representation, a product unit with supplements arranged in a folded newspaper and with an adhesive-tape portion connecting the two legs of the newspaper to one another.

The product unit shown in FIG. 1 exhibits a multiple-leaf printed product, i.e. a newspaper 10, which is folded along a transversely running fold 14. Those parts of the newspaper 10 which are arranged in each case on one side of the fold 14 are designated hereinbelow as legs 18.

Two supplements 20 in the form of magazines, brochures, periodicals or the like are arranged between the legs 18. Engaging around the open border 22 which is located opposite the fold 14, the so-called bloom of the newspaper 10, is an adhesive-tape portion 24 which adheres on the outer side 26 of the two legs 18 by means of its two end regions 24'.

Figure 2:
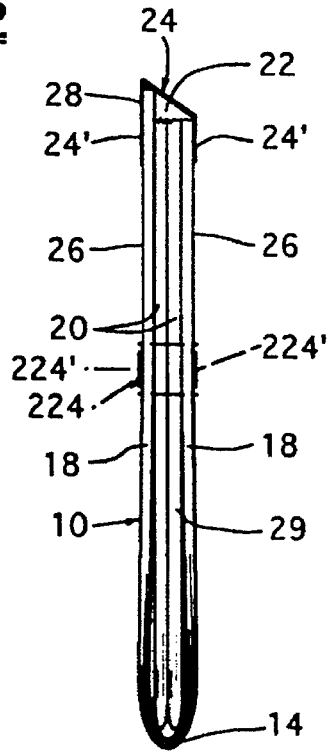
FIG. 2 shows, in elevation, a product unit according to FIG. 1, the newspaper exhibiting an overfold.

FIG. 2 shows a newspaper 10, of which one leg 18 projects beyond the other leg. The projecting part, known as overfold, is designated by 28. In the newspaper 10, two multiple-leaf supplements 20 are again arranged between the two legs 18. An adhesive-tape portion 24 adhering on the outer side of the legs 18 by means of its end regions 24' spans the open border 22.

In the case of the product units shown in FIGS. 1 and 2, the supplements 20 are inserted loosely into the newspaper 10. The adhesive-tape portion 24 connects the two legs 18 to one another, with the result that the supplements 20 are prevented from slipping out of the newspaper 10. Without the adhesive-tape portion 24 being destroyed, opening or bulging of the newspaper 10 is prevented. Preferably, the backing of the adhesive-tape portion 24 consists of a material which can be torn by hand, for example of a paper-like material. The adhesive-tape portion 24 may also be provided with an adhesive which permits the adhesive-tape portion 24 to be detached from the newspaper, for example by peeling off.

It is also conceivable to turn over the overfold 28, with the result that it spans the gap between the two legs 18, and thus the supplements 20.

In addition to the adhesive-tape portion 24 on the border 22, adhesive-tape portions may also be applied on the side edges 29 running at right angles to the border 22, in order also to prevent the supplements 20 from slipping out laterally. Such lateral adhesive-tape portions are specified in broken lines, and designated by 224, in FIGS. 1 and 2. Said adhesive-tape portions 224 adhere on the outer side 26 of the legs 18 by means of their end regions 224'.

Figure 3:
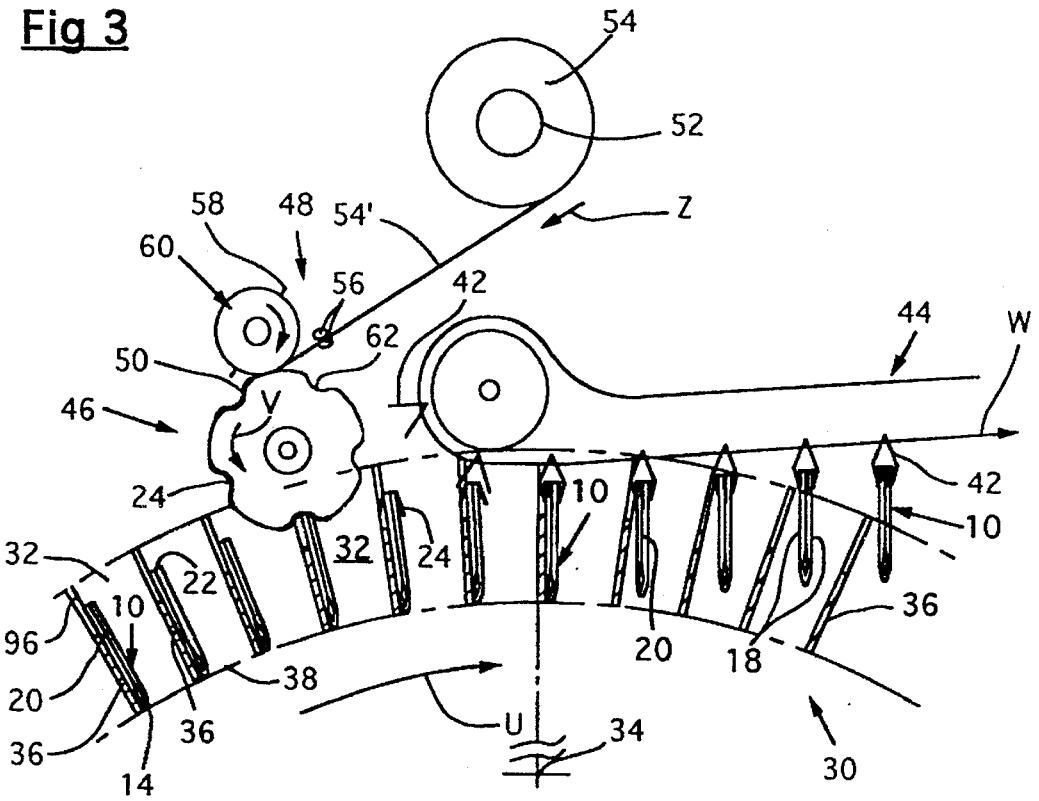
FIG. 3 shows part of a drum-like device for positioning supplements in a folded printed product, in particular a newspaper, and a device for applying an adhesive-tape portion which spans the legs of the printed products at the open border.

FIG. 3 shows, in section, part of a drum-like processing device which is intended for positioning supplements 20 in folded newspapers 10. Processing devices of this type are disclosed, for example, in CH-A-584 153 and EP-A-0 341 423 and in the corresponding U.S. Pat. Nos. 3,951,399 and 4,981,291. For the construction and functioning of the processing device 30, reference should be made to these publications, the disclosures of which are expressly incorporated herein by reference.

The processing device 30 exhibits pocket-like receiving parts 32 which are arranged around a common axis of rotation 34, extend in the direction of the axis of rotation, and are open towards the outside in the radial direction. The receiving parts 32 are delimited by walls 36 and, radially inwardly, by a base 38. In this processing device 30, the end products, composed of the newspaper 10 and the supplements 20 positioned therein, are produced in the manner described in the above mentioned preliminary publications.

FIG. 3 shows, then, the last portion of the processing device 30, from which, by means of the grippers 42 of a removal conveyor 44, the newspapers 10 with the supplements 20 arranged therein are removed and transported away in the conveying direction W. Arranged in this portion of the processing device 30, upstream of the removal conveyor 44 as seen in the direction of rotation U, is a device 46 for applying the adhesive-tape portions 24. It exhibits an adhesive-tape-portion dispensing unit 48 and a transfer wheel 50 which is intended for shifting the adhesive-tape portions 24, discharged from the adhesive-tape-portion dispensing unit 48, to the newspapers 10, arranged in the receiving parts 32 and transported therein, and for applying the adhesive-tape portions 24 onto the newspapers 10.

The adhesive-tape dispensing unit 48 exhibits a bearing shaft 52 on which there is mounted an adhesive-tape supply roll 54, from which there may be drawn off in a stepwise manner, by means of a conveying-roller pair 56, adhesive tape 54' from which adhesive-tape portions 24 are separated off by means of the cutters 58 of a cutting roller 60 which can be driven in rotation.

Figure 4:
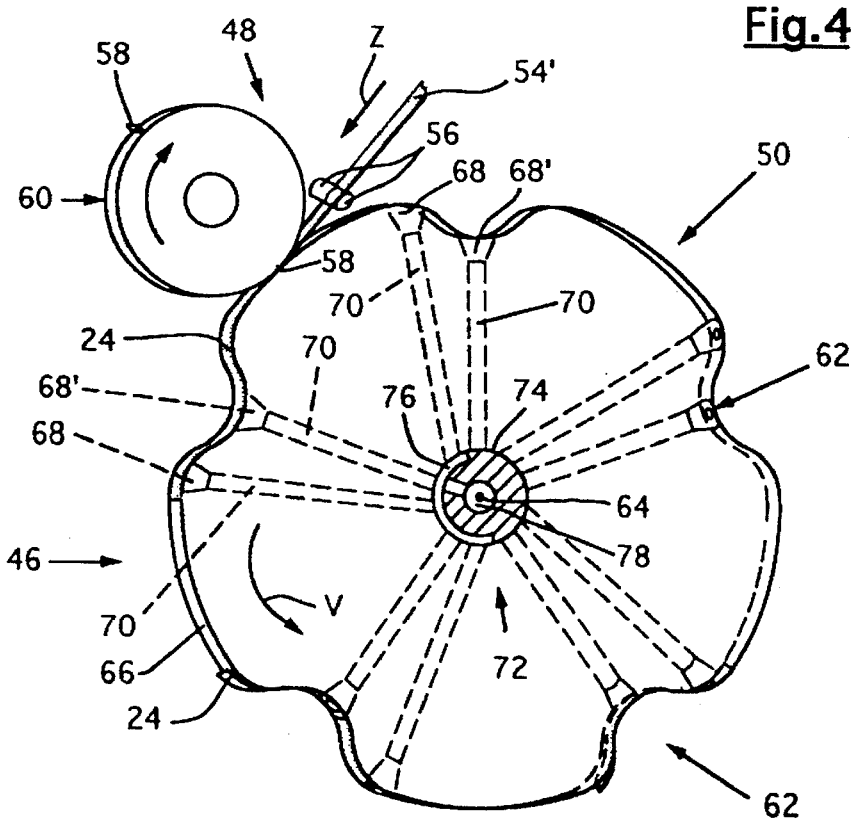
FIG. 4 shows, in perspective representation and on an enlarged scale, that part of the device which is shown in FIG. 3 and is intended for applying the adhesive-tape portion.

As can be seen, in particular, also in FIG. 4, the essentially circular transfer wheel 50 exhibits indents 62 which are distributed on the circumference and of which the centre-to-centre distance, measured in the circumferential direction, corresponds essentially to the distance between the walls 36 of the processing device 30. The transfer wheel 50 is driven in rotation in arrow direction V, which is counter to the direction of rotation U, about an axis of rotation 64 parallel to the axis of rotation 34. The circumferential speed of the transfer wheel 50 corresponds approximately to the speed of rotation of the walls 36, and the transfer wheel 50 is synchronized with the processing device 30 such that in each case the upper border 22 of a newspaper 10 comes to be located in an indent 62, as can be seen, in particular, in FIG. 3.

In each case at the root of each indent 62 and in the cylindrical part between the indents 62, the outer surface 66 of the transfer wheel 50 exhibits a suction opening 68 and 68', respectively, in each case adjacent to the leading edge of each indent 62, as seen in arrow direction V. The suction openings 68, 68' are connected to a valve arrangement 72 via radial suction ducts 70 in order to connect the suction openings 68, 68' temporarily to a subatmospheric-pressure source (not shown). The valve arrangement 72 exhibits a control disk 74 having a control groove 76 which is open towards outside in the radial direction and extends, in the circumferential direction, over a specific region. The control groove 76 is connected, on the one hand, to the subatmospheric-pressure source via a suction line 78 and, on the other hand, to the suction openings 68, 68' in each case by means of the suction ducts 70 when, upon rotation of the transfer wheel 50 round the control disk 74, the inner ends of the suction ducts 70 are located in the region of the control groove 76.

As can be seen, in particular, in FIG. 4, part of the adhesive tape 54' projects beyond the conveying-roller pair 56 and butts against the outer surface 66 of the transfer wheel 50 by means of its adhesive-free flat side which is directed towards said transfer wheel 50. If a suction opening 68 comes into the region of said part of the adhesive tape 54', said suction opening 68 is connected to the subatmospheric-pressure source by means of the valve arrangement 72, and the conveying-roller pair 56 is simultaneously driven in the conveying direction Z. Consequently, the leading end region of the adhesive tape 54' is retained on the outer surface 66 and the following part is inserted into the indent 62. For this purpose, the conveying speed of the conveying-roller pair 56 is temporarily correspondingly greater than the speed of rotation of the transfer wheel 50. In order to retain the adhesive tape 54' in the indent 62, the suction opening 68' is then also connected to the subatmospheric-pressure source. By means of the then likewise driven cutting roller 60, the adhesive tape 54' is severed in order to separate off an adhesive-tape portion 24, the portion of the outer surface 66 between two indents 62 serving as a rest which interacts with the cutter 58. Upon rotation, the transfer wheel 50 thus receives, by each indent 62 in each case, an adhesive-tape portion 24 which extends beyond the indent 62 by means of its end portions.

During the rotation of the processing device 30 and of the transfer wheel 50, in each case one newspaper 10 comes to be located in an indent 62 by means of its open border 22. The distance between the axis of rotation 64 and the newspapers 10 is, in this arrangement, adjusted such that the adhesive-tape portion 24 comes to butt against the newspaper in the region of the open border 22, and is lightly pressed thereon, by means of its adhesive coating, which is radially on the exterior with respect to the transfer wheel 50. Admitting air into the suction openings 68 and 68' releases the adhesive-tape portion 24, now adhering on the newspaper 10. During further rotation of the processing device 30, in each case one gripper 42 of the removal conveyor 44 engages, from above, around the newspaper 10 with the supplements 20 arranged therein, and, upon closure of the gripper jaw, presses the end regions 24', of the adhesive-tape portion 24, which project beyond the open border 22 onto the legs 18 and holds the product unit firmly in order to transport it away.

Figure 5:
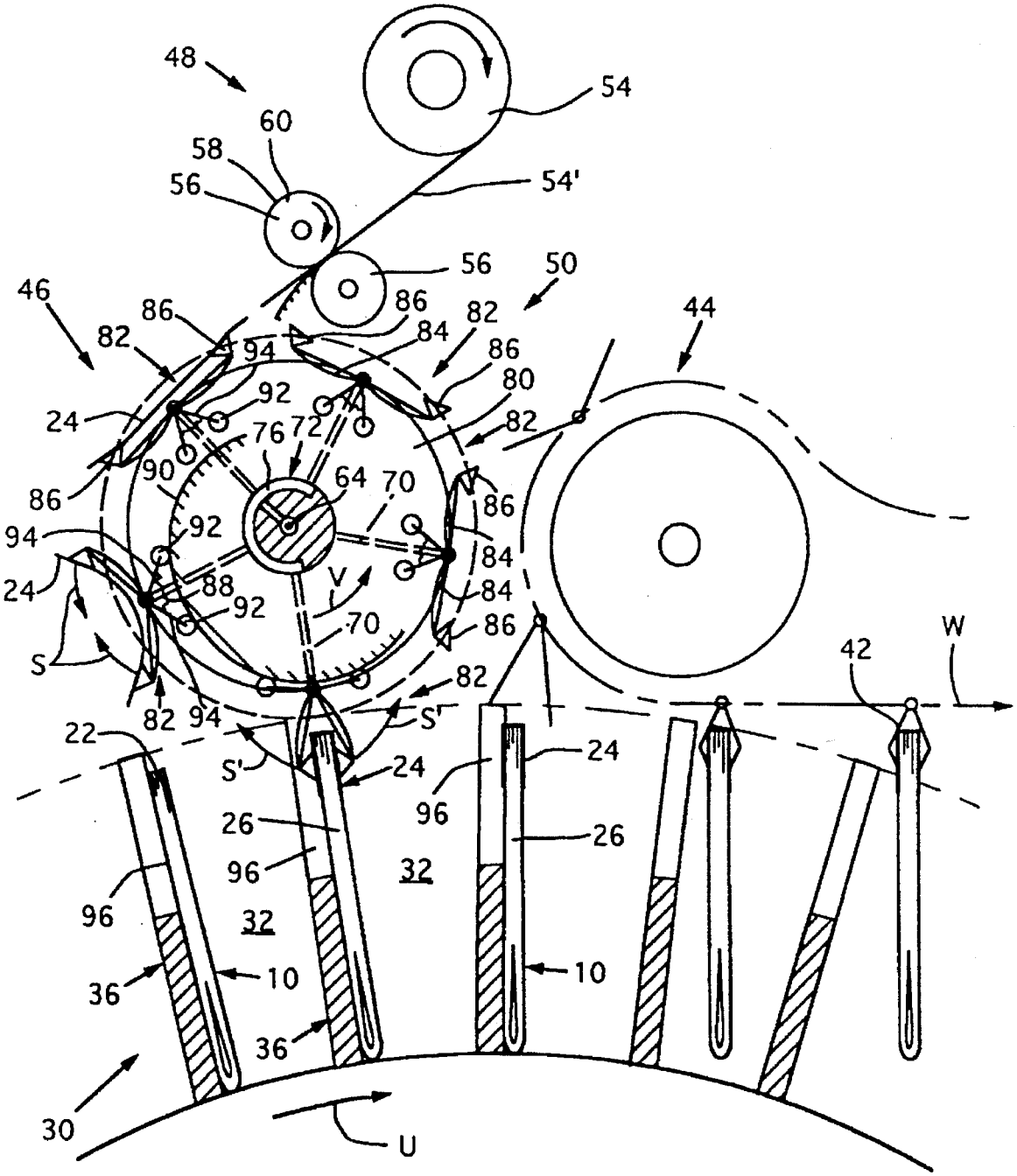
FIG. 5 shows, in the same representation as in FIG. 3, a further embodiment of the device for applying the adhesive-tape portion.

In the same representation as FIG. 3, FIG. 5 shows a further possible embodiment of the transfer wheel 50. It exhibits a carrying disk 80 which is driven in rotation in arrow direction V around the axis of rotation 64 and on which there are arranged transfer tongs 82 which are distributed in the circumferential direction. Arranged at the ends of the tong jaws 84 of the transfer tongs 82 are suction heads 86 which are likewise connected to a valve arrangement 72 via suction ducts 70, as is described above in conjunction with FIG. 4. By means of a spring element 88, the tong jaws 84 are prestressed in the open position and, by means of a slotted guide 90 which interacts with sliding blocks 92 on the tong levers 94, can be moved into the closed position in dependence on the rotational position of the carrying disk 80.

When the leading suction head 86, as seen in direction of rotation V, of opened transfer tongs 82 runs past the adhesive-tape-portion dispensing unit 48, the conveying-roller pair 56 is set into motion and the suction head 86 is connected to the subatmospheric-pressure source. As soon as the trailing suction head 86 of said transfer tongs 82 also runs past the adhesive-tape-portion dispensing unit 48, said suction head takes up the adhesive tape 54' and the conveying-roller pair 56, which is also designed as a cutting tool in this case, separates the adhesive-tape portion 24, now retained by the transfer tongs 82, from the adhesive tape 54'. During further rotation, the transfer tongs 82 are gradually closed, as shown by the arrows S. The adhesive-tape portion 24 is thus bent in the form of a U and engages around the open border 22 of the newspaper 10 as soon as the movement path of the tong jaws 84 intersects the movement path of the open border 22. Subsequently, the transfer tongs 82 are then closed fully in order to press on the adhesive-tape portion 24 on the outer side 26 of the legs 18. Air is then admitted into the two suction heads 86 of the relevant transfer tongs 82, and the tong jaws 84 are moved back into the open position (arrows S').

Here too, the newspapers 10 with the supplements 20 arranged therein are located in receiving parts 32 of the processing device 30, as is shown in FIG. 3 and described above. Here too, the resulting product units are seized by means of a removal conveyor 44 and transported away for further processing. In order that the transfer tongs 82 and the grippers 42 of the removal conveyor 44 can be positioned on the newspaper 10, the walls 36 of the processing device 30 exhibit cutouts 96 (see also FIG. 3).

Figure 6:
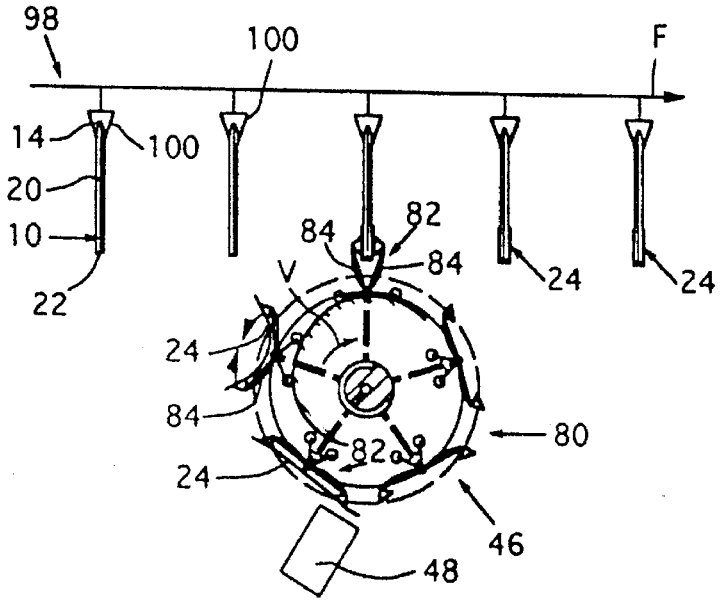
FIG. 6 shows a device for applying the adhesive-tape portion on printed products, transported in a suspended manner by means of a gripper conveyor, with supplements arranged therein.

In the case of the apparatus according to FIG. 6, the newspapers 10 with the supplements 20 arranged therein are transported, in conveying direction F, in a vertical suspended position by means of a clamp conveyor 98. In this arrangement, the clamps 100 of the clamp conveyor 98 engage around the newspapers 10 and retain the same. The fold 14, located at the top, of the newspapers 10 runs at right angles with respect to conveying direction F and the open border 22, located at the bottom, is freely accessible from beneath.

Located beneath the clamp conveyor 98 is a device 46 for applying in each case one adhesive-tape portion 24 onto the newspapers 10, said adhesive-tape portion spanning the open border 22. This device 46 is of exactly the same design as that shown in FIG. 5 and exhibits tong jaws 84 arranged on a carrying disk 80 driven in direction of rotation V. Said tong jaws receive in each case one adhesive-tape portion 24 from the adhesive-tape-portion dispensing unit 48 and apply said portion onto the newspaper 10 such that it engages around the open border 22.

Figure 7:
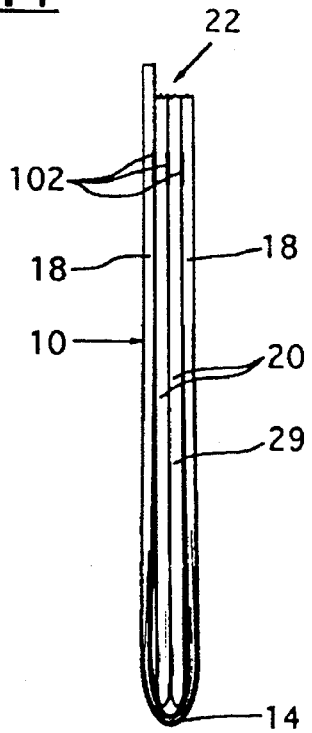
FIG. 7 shows, in the same representation as FIG. 2, a product unit with supplements arranged in a folded newspaper, the legs of the printed product and the supplements being connected to one another by means of an anti-slip agent.

FIG. 7 shows, as do FIGS. 1 and 2, a folded newspaper 10 with two supplements 20 arranged therein. The supplements 20 and, if appropriate, the legs 18 of the newspaper 10 are provided, in a predetermined region, with an anti-slip agent 102, for example a transparent silicone coating. In this arrangement, in each case at least one such region is located in each surface by which the supplements 20 are in contact with one another and by which the supplements 20 are in contact with the legs 18 of the newspaper 10. Consequently, the supplements 20 are stopped from being displaced with respect to the legs 18 and with respect to one another.

Figure 8:
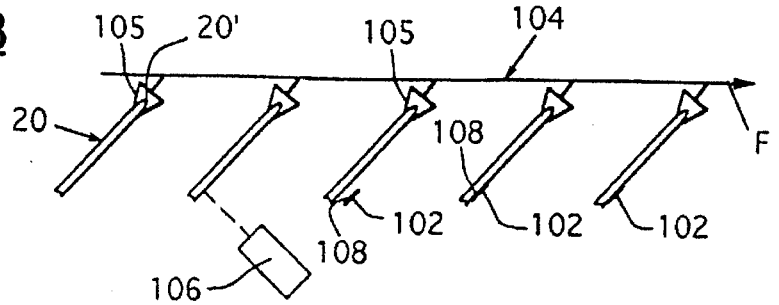
FIG. 8 shows a device for spraying anti-slip agent onto supplements.

FIG. 8 shows an embodiment of a device for applying an anti-slip agent 102 onto the outer side of a supplement 20. By means of a gripper conveyor 104, the supplements 20 are transported individually in a rearwardly and downwardly sloping position, with respect to the horizontal conveying direction F, the grippers 105 retaining the supplements 20 at the leading fold 20', as seen in conveying direction F. Arranged beneath the gripper conveyor 104 is a spraying device 106 which applies anti-slip agent 102 onto each supplement 20, transported past it, in a predetermined region 108 remote from the fold 20'.

Figure 9:
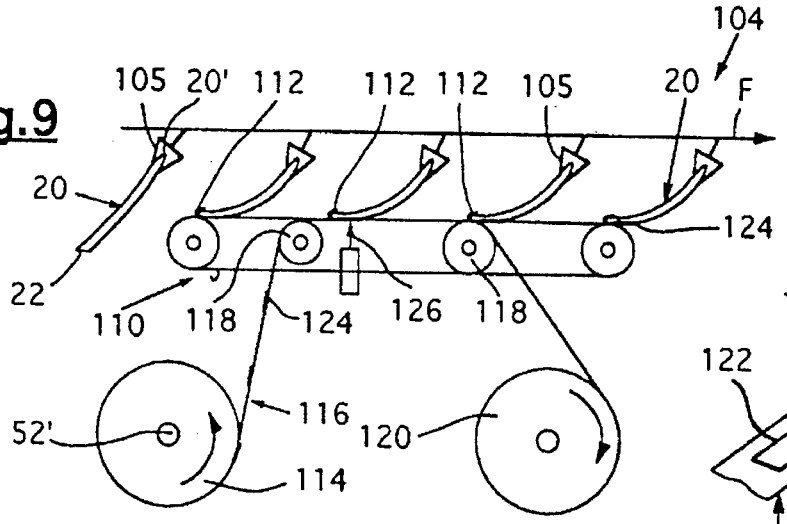
FIG. 9 shows a device for applying tape portions, acting as anti-slip agent, on supplements.
Figure 10:
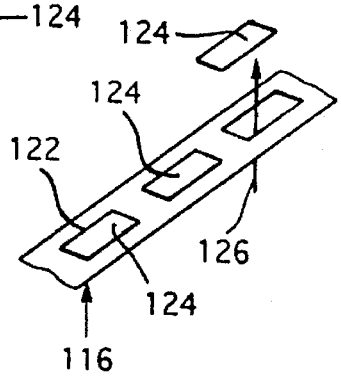
FIG. 10 shows, in perspective representation, part of a supply tape with tape portions.

In the case of the embodiment shown in FIG. 9, the supplements 20 are likewise transported by means of a gripper conveyor 104 in a rearwardly and downwardly sloping suspended position, with respect to the conveying direction F. Arranged beneath the gripper conveyor 104 is a supporting belt 110 which is driven in rotation, of which the upper supporting strand runs parallel to the gripper conveyor 104, and is driven at the same speed as the gripper conveyor 104. Arranged on the supporting belt 110, by the spacing of the grippers, are retaining cams 112 which are intended, together with the supporting belt 110, for grasping the supplements 20 in the region of the open border 22. Arranged beneath the supporting belt 110, on a bearing shaft 52', is a supply reel 114, from which a self-adhesive anti-slip tape, guided around two deflection rollers 118, runs to a take-up reel 120. As can be seen in FIG. 10, perforations 122 in the anti-slip tape 116 delimit label-like tape portions 124. Arranged between the two deflection rollers 118 is a push rod 126 which is driven, for example, by means of a cylinder/piston unit, separates in each case one self-adhesive tape section 124 from the anti-slip tape 116, in doing so separating the perforation 122, and applies it onto the flat side, located at the bottom, of the supplement 20. In this arrangement, the retaining cams 112 serve as counter-retaining means. To complete the picture, it should be mentioned that the anti-slip tape 116 is driven in time with the gripper conveyor 104, with the result that there is in each case one tape section 124 for each supplement 20.

Of course, an anti-slip agent 102 can also be applied on the other side of the supplement 20 by means of a device analogous to FIG. 8 or 9.

The supplements 20 provided with anti-slip agent 102 are fed to a processing device 30, as is shown, for example, in FIG. 3. There, the supplements 20 are positioned in newspapers 10. The resulting product units are then transported away by means of the removal conveyor 44.

It is also conceivable to connect the two legs 18 of the newspapers 10 to one another at a plurality of locations.

In the case of the exemplary embodiments shown, the supplements 20 are arranged centrally in the folded newspaper 10. It is, however, also possible to arrange the supplements 20 between different parts of the newspaper 10. The term legs is then to be taken as those parts of the newspaper 10 which are arranged on both sides of the supplements 20.

It is also conceivable, instead of a newspaper 10, to use another type of printed product, for example a periodical.

Figure 11:
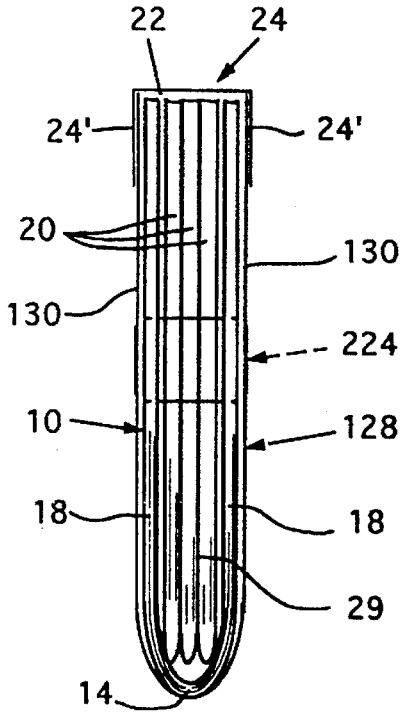
FIG. 11 shows, in a similar representation to FIG. 2, a product unit with a protective cover.

FIG. 11 shows a product unit in the case of which, in the same way as in the case of the product unit according to FIG. 1, three supplements 20 are arranged between the legs 18 of the newspaper or periodical 10 folded along the fold 14. In contrast to the embodiment according to FIG. 1, a cover 128 is laid around the newspaper 10, said cover likewise being open at the open border 22. In the region of the open border 22, the cover 128 is held together by an adhesive-tape portion 24, of which the end regions 24' adhere on the outer side 130 of the cover 128. In addition to this adhesive-tape portion 24, additional adhesive-tape portions 224 may be arranged in the region of the side edges 29 of the product unit, as is shown in broken lines in FIG. 11 and has already been described with reference to FIGS. 1 and 2.

Figure 12:
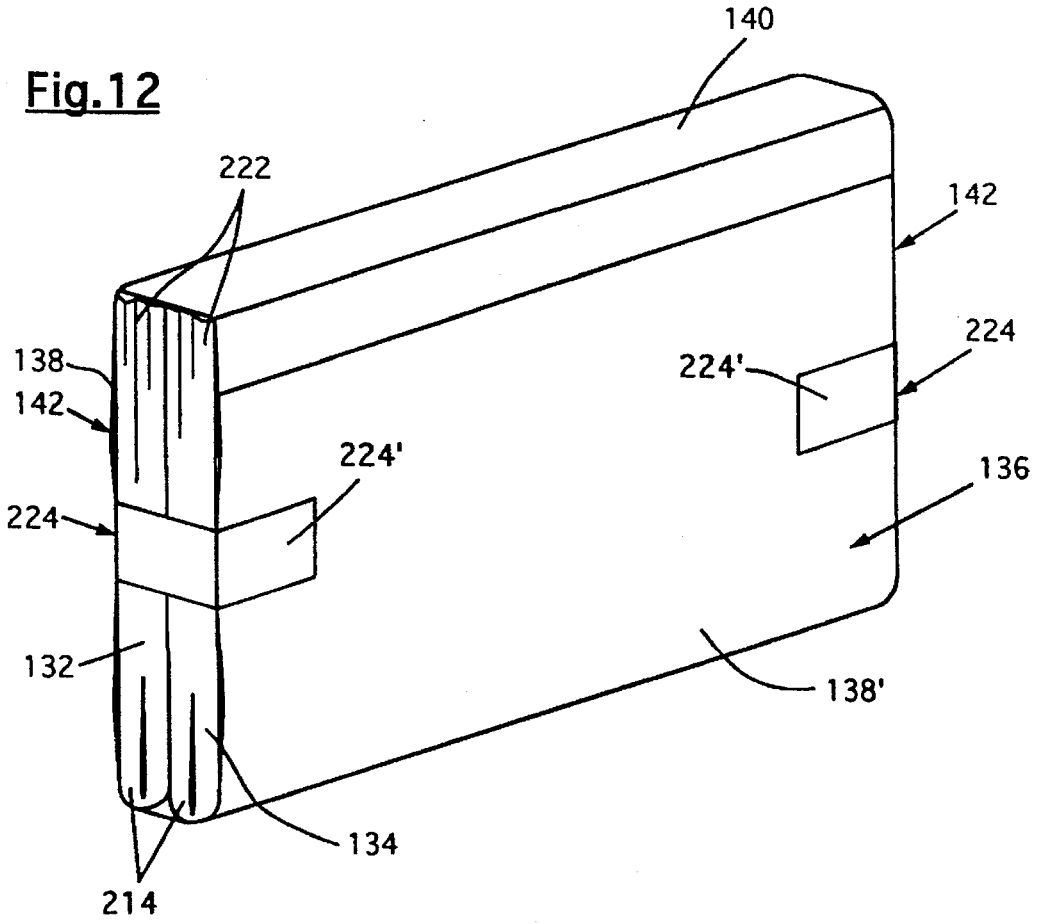
FIG. 12 shows, in perspective representation, a product unit with a protective sheath.

In the case of the product unit shown in FIG. 12, two printed products 132, 134, which are located one beside the other and are folded along the edge 214, are enclosed by a sheath 136. In this arrangement, one side part 138 of the sheath 136 engages over the printed products 132, 134, at the open border 222 thereof, by means of a closure flap 140 which is fastened on the other side part 138' of the sheath 136. On the open sides 142 of the product unit there are provided, as in the case of the embodiments according to FIGS. 1 and 2, adhesive-tape portions 224 which adhere on the outside of the side parts 138, 138' of the sheath 136 by means of their end regions 224'. The adhesive-tape portions 224 prevent the printed products 132, 134 from being able to slide out laterally.

The printed products 132, 134 may be newspapers or periodicals or else also parts thereof, e.g. supplements.

The cover 128 and the sheath 136 serve to hold together and to protect the packs or bundles of printed products 10, 20, 132, 134 and consist, for example, of paper or plastic.

It is also conceivable, in the case of the product units according to FIGS. 11 and 12, to provide the outer sides of the printed products 10, 20, 132, 134 with an anti-slip protection, instead of the adhesive-tape portions 24, 224 or in addition thereto, as has been explained with reference to FIGS. 7 to 10.

Finally, it should further be pointed out that it is possible, in the case of the product unit shown in FIG. 11, to arrange the individual printed products 10, 20 one beside the other, as is shown in FIG. 12. Correspondingly, in the case of the product unit according to FIG. 12, the printed products 132, 134 may be laid one inside the other, as is shown in FIG. 11.

In the drawings and specification, there has been set forth a preferred embodiment of the invention, and although specific terms are employed, they are used in a generic and descriptive sense only and not for purposes of limitation.

I claim:

1. A process for producing multiple-part printed product units comprising the steps of providing an outer part which is folded upon itself to define a fold, opposite legs, an open border opposite the fold, and opposite open sides which extend from the fold to the open border, positioning at least one printed product between the opposite legs of the outer part, and separably connecting the legs of the outer part to one another indirectly via the at least one printed product located therebetween, and such that the opposite legs of the outer part are separably connected to said at least one printed product.

2. The process as claimed in claim 1, wherein a plurality of printed products are positioned between the opposite legs of the outer part, and wherein the legs are separably connected to the printed products located therebetween, and said printed products are connected to one another.

3. The process as claimed in claim 2, wherein the legs and the printed products located therebetween are connected to one another in predetermined regions by means of an anti-slip agent or an adhesion agent.

4. The process as claimed in claim 3, wherein the anti-slip agent or the adhesion agent is sprayed onto the printed products and/or the legs or applied thereon in the form of tape portions.

5. An apparatus for producing multiple-part printed product units each comprising an outer part which is folded upon itself to define a fold, opposite legs, an open border opposite the fold, and opposite open sides which extend from the fold to the open border, said apparatus comprising processing and transporting means for individually transporting the outer parts with at least one printed product arranged between the opposite legs of each product unit, and means for applying a connection means which separably connects to one another the opposite legs of the outer part of each product unit at the open border and during the transporting of the outer parts, the means for applying a connection means including an adhesive-tape portion dispensing unit, means for applying an adhesive-tape portion, discharged from the adhesive-tape portion dispensing unit, on the outer side of the outer part of each product unit such that it spans the open border, the means for applying the adhesive-tape portion including a rotationally driven transfer wheel which is intended for receiving, from the adhesive-tape portion dispensing unit, by means of its outer surface, an adhesive-tape portion with radially exterior adhesive coating and for applying this onto the open border of the outer part, and a gripper conveyor provided downstream of the transfer wheel as seen in the transporting direction, said gripper conveyor including a plurality of gripping means for seizing and retaining each outer part and the printed products located therein, in the region of the open border, for transporting them away, and for pressing the end regions of the adhesive-tape portion onto the outer side of the outer part.

6. The apparatus as defined in claim 5 wherein the processing and transporting means includes pocket-like receiving parts which are configured for receiving in each case one outer part with the printed products arranged therein and with the fold butting against the base of the receiving part.

7. An apparatus for producing multiple-part printed product units each comprising an outer part which is folded upon itself to define a fold, opposite legs, an open border opposite the fold, and opposite open sides which extend from the fold to the open border, said apparatus comprising processing and transporting means for individually transporting the outer parts with at least one printed product arranged between the opposite legs of each product unit, and means for applying a connection means which separably connects to one another the opposite legs of the outer part of each product unit at the open border and during the transporting of the outer parts, the means for applying a connection means including an adhesive-tape portion dispensing unit, means for applying an adhesive-tape portion, discharged from the adhesive-tape portion dispensing unit, on the outer side of the outer part of each product unit such that it spans the open border, the means for applying the adhesive-tape portion including a tong-like transfer means which is configured, in an open state, to receive from the adhesive-tape portion dispensing unit, and temporarily to retain an adhesive-tape portion with an adhesive coating applied on the side directed away from the transfer means, and control means for shifting the transfer means into a position engaging around the outer part together with the printed products contained therein, at the open border and closing the transfer means in order to apply and to press the adhesive-tape portion onto the outer side of the legs such that it spans the open border.

8. The apparatus as claimed in claim 7 wherein said processing and transporting means includes pocket-like receiving parts which are configured for receiving in each case one outer part with the printed products arranged therein and with the fold butting against the base of the receiving part.

9. The apparatus as claimed in claim 8 wherein said processing and transporting means further includes clamp conveyor means including clamps for seizing and retaining each outer part and the printed products arranged therein.

10. The apparatus as claimed in claim 7 wherein said processing and transporting means includes clamp conveyor means including clamps for engaging around the fold of each outer part to retain the printed products arranged therein.

11. The apparatus for producing multiple-part printed product units each comprising an outer part which is folded upon itself to define a fold, opposite legs, an open border opposite the fold, and opposite open sides which extend from the fold to the open border, and at least one printed product positioned between the legs of the outer part, said apparatus comprising conveying means for individually transporting the printed products, means for applying a connecting means in a specific region on the outer side of each of the printed products being conveyed, processing means for bringing the printed products, which have been released from the conveying means and provided with connecting means, together with respective outer parts to form product units, and a removal conveyor for guiding the product units away from the processing means.

12. A multiple-part printed product unit comprising an outer part which is folded upon itself to define a fold, opposite legs, an open border opposite the fold, and opposite open sides which extend from the fold to the open border, at least one printed product positioned between the legs, the legs of the outer product being separably connected to one another by connecting means indirectly via the at least one printed product located therebetween, and such that the opposite legs of the outer part are separably connected to said at least one printed product.

13. The product unit as claimed in claim 1, wherein the legs of the outer part and the at least one printed product located therebetween are connected to one another in predetermined regions by means of an anti-slip agent or an adhesion agent.

14. The product unit as claimed in claim 7, wherein the outer part is formed by a printed product, or by a cover element.

* * * * *